United States Patent [19]

Kornerup et al.

[11] 4,429,494

[45] Feb. 7, 1984

[54] WINDOW, ESPECIALLY FOR INSTALLATION IN AN INCLINED ROOF

[75] Inventors: Klaus Kornerup, Birkerød, Denmark; Per B. Christensen, Puerto del Carmen Lanzarote, Canary Islands

[73] Assignee: V. Kann Rasmussen Holding A/S, Søborg, Denmark

[21] Appl. No.: 419,328

[22] Filed: Sep. 17, 1982

[30] Foreign Application Priority Data

Dec. 8, 1981 [DK] Denmark ..... 5421/81

[51] Int. Cl.[3] ..... E05F 1/10

[52] U.S. Cl. ..... 49/386; 49/346

[58] Field of Search ..... 49/381, 386, 379, 346

[56] References Cited

U.S. PATENT DOCUMENTS

| | | | |
|---|---|---|---|
| 3,704,550 | 12/1972 | Hancock | 49/386 |
| 3,918,205 | 11/1975 | Rasmussen | 49/252 |
| 4,064,649 | 12/1977 | Rasmussen et al. | 49/250 |
| 4,217,732 | 8/1980 | Reichstadt | 49/386 X |

FOREIGN PATENT DOCUMENTS 145270 7/1980 Denmark .

*Primary Examiner*—Philip C. Kannan

*Attorney, Agent, or Firm*—Lane, Aitken & Kananen

[57] ABSTRACT

In a window, especially for installation in an inclined roof, a secondary frame element or sash is connected with the stationary main frame of the window in a top hinge and is urged in its opening direction by a lifting lever hinged at its one end through a pivot pin to a side member of the secondary frame element or the main frame, while its other end is pivotally and displaceably connected with the adjacent member of the main frame or the secondary frame element, respectively, said lever being biassed by a spring tending to displace said other end in a direction corresponding to opening the window.

The said other end of the lever is provided with several pins which during the opening or closing movement of the window successively become operative as the pivot point, thereby giving the lever a varying effective length, whereby the curve of the spring balancing moment performed on the frame element may be optimized and, if desired, a series of stable positions of rest for the tilting frame may be obtained.

3 Claims, 3 Drawing Figures

WINDOW, ESPECIALLY FOR INSTALLATION IN AN INCLINED ROOF

BACKGROUND OF THE INVENTION

In windows for installation in an inclined roof and comprising a main frame and a top-hinged secondary frame element which in itself may be provided with one or more glass panes or in which a pane supporting tilting sash may be mounted it is known to balance at least part of the weight of the movable components by means of a lever inserted between a pair of associated side members of the main frame and the secondary frame element, respectively, and having one end pivotally connected with one of the side members while its other end is hinged to a sliding shoe displaceable along the other side member, said shoe being urged by a tension spring in a direction so as to exert an outwardly directed pressure through the lever on the secondary frame element. The purpose of this arrangement is to facilitate opening the window, and the dimensions may be chosen so that the spring can retain the top-hinged secondary frame in equilibrium in a desired opening position.

A deficiency of the prior art balancing mechanisms of said type constitutes in that the tension spring in and adjacent the closing position of the window only produces a very light lifting moment or possibly no lifting effect at all on the secondary frame element because the centre line of the tension spring passes through or is located very close to the hinge axis of the secondar frame element and cannot either be spaced far from the pivot point at the other end of the lever. This entails that the window at initial opening requires a considerable force action and that the secondary frame element when being reclosed strikes heavily against the main frame if efficient restraining provisions are not made. In other words, the curve of the balancing moment has an inappropriate course, and only in a single position the mechanism fully balances the secondary frame element.

A more suitable course of the lifting moment curve is obtained by a design in which a tension spring extending along a side member of a main frame or a sash has its lower end connected with a sash lifting lever while its upper end is secured to another lever, one end of which is likewise pivoted to the sash or the main frame. From its pivot point this lever extends upwardly towards the upper edge of the window and it slidingly engages the main frame or sash member and is held thereagainst by the spring due to the fact that the centre line of the spring even in this situation is spaced outwardly from the pivot points of said two levers on the sash or main frame.

By choosing appropriate dimensions for this prior art design the entire moment curve may follow at least approximately an ideal course but, in return, the structure is much more complicated than is the case with the first mentioned balancing or lifting mechanism.

AIM AND SUMMARY OF THE INVENTION

It is a purpose of the invention to combine a structurally simple design with the possibility of providing such a course of said moment curve that the sash of the window is easily moved from closed to fully open position and, if desired, may further occupy one or more arrested or predetermined intermediate positions.

Accordingly, and taking the first mentioned prior design as its starting point, the invention relates to a window, especially for installation in an inclined roof, comprising a main frame, a secondary frame element top-hinged therein, and a frame element lifting lever inserted therebetween, said lever being at its one end pivotally connected with a side member of the secondary frame element or the main frame while its other end is pivotally and displaceably connected with the associated side member of the main frame or the secondary frame element, respectively, and is urged by a spring for displacement along said side member in a direction away from the hinge point between the main frame and the secondary element. The particular feature of such a window according to the invention is that said other end of the secondary frame lifting lever presents at least two pivot points having different distances from the pivot point at the first mentioned end of the lever and being, moreover, located so as to successively becoming operative during the opening of the window to successively increasing the effective length of the lever.

The ability of the spring and the lever to urge the secondary frame element in its opening direction depends on the fact that already in the closed position of the window the direction of the lever represented by the connecting line of its bearing or pivot points on the frame and the secondary frame element, respectively, forms an angle of a certain, although modest magnitude with the window plane. This condition is obviously easiest fulfilled if the lever is short, but this implies on the other hand, firstly that the maximum tilting of the secondary frame element of the window will become more restricted than desired and, secondly, that the mentioned moment curve will assume a course that is too steep because the component, perpendicular to the window plane, of the spring force exerted through the lever is a sine function of the angle of the lever with said plane and consequently is increasing faster than desired during the opening movement of the secondary frame element when the lever is short. Both of those two drawbacks are remedied by the successive variation of the effective lever length provided by the invention. Such variation may for instance be continuous inasmuch as the said other end of the lever may be designed to perform a rolling and sliding movement in relation to the side member concerned, but it may as well be stepwise, the secondary frame element having then an arrested position corresponding to each step, i.e. at any transition from one pivot point to another.

The latter item applies to a preferred embodiment of the invention, in which the said other end of the secondary frame element lifting lever is connected with the spring through a slide displaceable along the side member concerned, and wherein said lever comprises three approximately equidistant pivot pins, the central one of which is laterally displaced from the connecting line between the two other pivot pins in a direction pointing away from the first mentioned end of the lever, the slide comprising three corresponding bearing recesses which are mainly in alignment with each other. In this case two jumps are thus effected in the moment curve meaning that the secondary frame element may be stable in two different opening positions when a suitable spring force is chosen.

DETAILED DESCRIPTION OF THE PREFERRED EMBODIMENT

Figure 1:
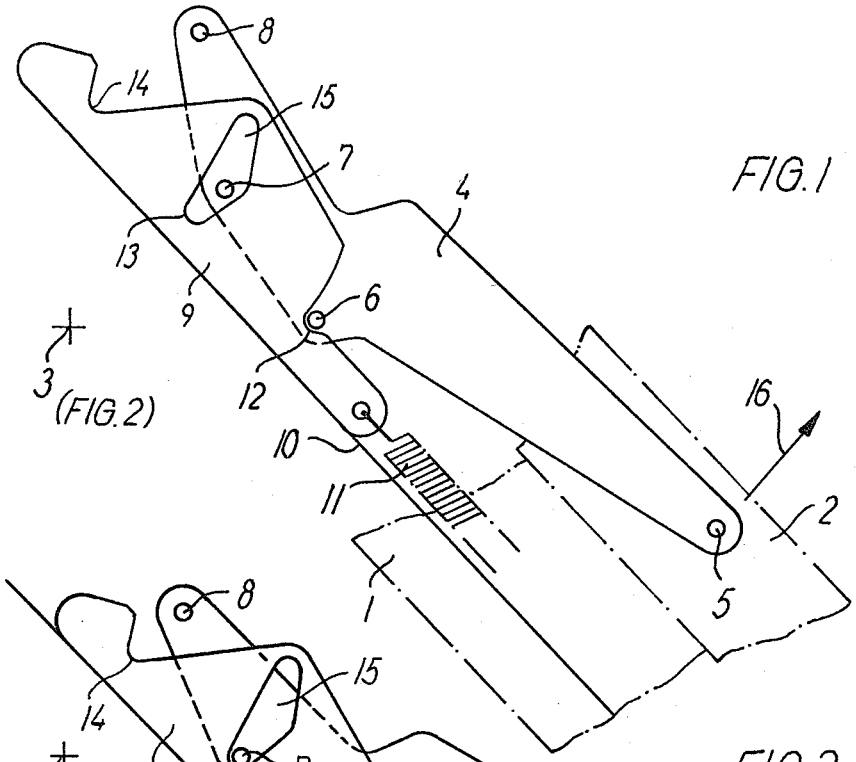
FIGS. 1, 2 and 3 illustrate diagrammatically the main frame and the frame element of a preferred embodiment of the window according to the invention as well as its balancing mechanism in the closed position of the window and in either of its two mentioned, stable opening positions.

In the drawing 1 designates a side member of a main frame installed in a roof, not shown, with an inclination of about 45°, and 2 is a corresponding side member of a secondary frame element or sash which, as already mentioned, in itself may support a window pane or may constitute an intermediate frame between the main frame 1 and a pane supporting tilting sash. The secondary frame element 2 is connected with the main frame 1 by a top hinge 3 which is marked only in FIGS. 2 and 3. The main frame 1 and the secondary frame element 2 are further connected with each other through a lifting lever 4 which at one end is hinged through a pivot pin 5 to the secondary frame element 2 while pivot pins 6, 7 and 8 adjacent its other end connect the lever with a slide 9 displaceable along a guidance 10 in the side member 1 of the main frame, said slide being secured to one end of a tension spring 11 mounted in said side member. The tensioning of said spring may be adjustable in a well known manner.

The said three pivot pins 6, 7 and 8 are approximately equidistant and the central pin 7 is somewhat laterally displaced in the direction towards the guidance 10 from the connecting line of the two other pins. It is also apparent that from the pin 5 at the first end of the lever 4 the distance to the pin 7 is greater than to the pin 6 and even greater is the distance to the pin 8.

For each of the pins 6, 7 and 8 the slide 9 presents a bearing recess 12, 13 and 14, respectively, the recess 13 being constituted by the end portion nearest the guidance 10 of an elongate aperture 15 provided in the slide.

In the closing position, FIG. 1, only the pivot pin 6 of the lever 4 engages the associate recess 12, and in this situation the effective length of the lifting lever is the distance between the pins 5 and 6. When opening the window the pivot pin 5 will follow a circular course having its centre in the top hinge 3. This movement is indicated by the arrow 16. At the same time the lever 4 tilts about the pivot pin 5, meaning that the engagement between the pin 6 and the recess 12 necessitates a downwardly directed displacement of the slide 9. However, the spring 11 urges the slide in the same direction so as to contribute to performing the lifting action on the secondary frame element 2.

Figure 2:
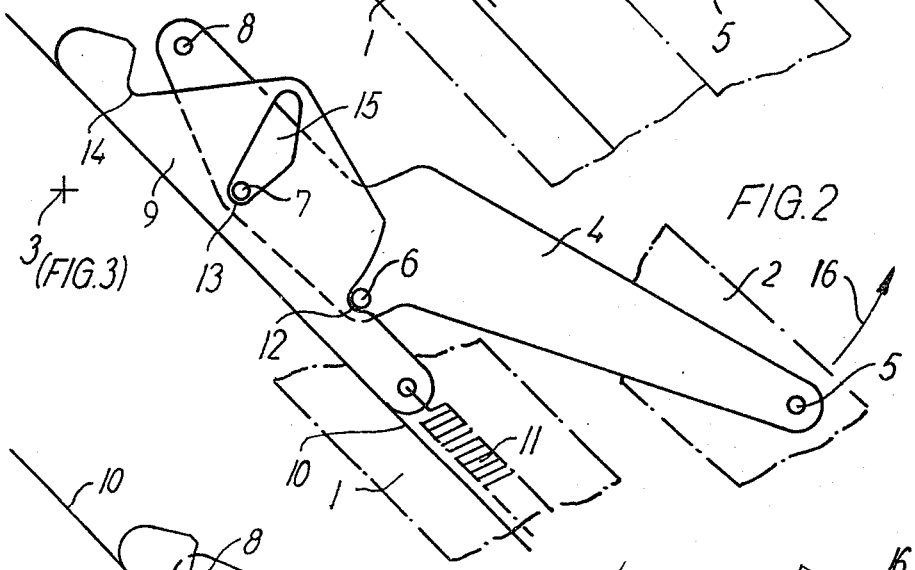

In FIG. 2 the lever has been tilted so much about the pin 6 that also the following pin 7 has found bearing in its recess 13. During a continued movement of the secondary frame element 2 in the opening direction the pin 7 now takes over practically the function performed so far by the pin 6, and the effective length of the lever 4 is increased by a step to the distance between the pins 5 and 7. At the same time only an infinitesimal change of the tensioning of the spring 11 has occurred, but the effective direction of the lever 4 has changed (from line 5–6 to line 5–7) resulting in a decline of the balancing moment exerted by the spring 11 via the lever 4. The magnitude of this "transitional moment" may be adapted so that the secondary frame element 2 is stable in the position in FIG. 2. An outwardly directed push upon the frame element 2 may overcome the resulting gravitational moment tending to swing the frame element clockwise around the top hinge 3, and after a small counter-clockwise swinging of the frame element the balancing moment produced by the spring 11 will have increased sufficiently, due to the angular movement of the lever 4, to overcome said gravitational moment so that the opening movement of the frame element continues automatically.

Figure 3:
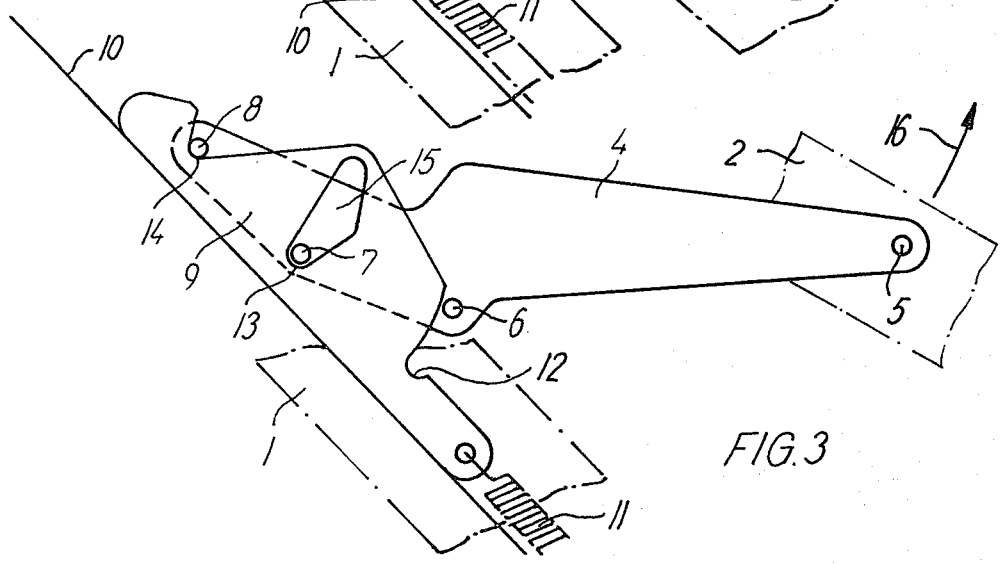

Analogously, the same applies to the transitional situation illustrated in FIG. 3 from the tilting of the lever about pin 7 to its tilting about pin 8 now engaging the recess 14.

During the continued movement of the secondary sash 2 in the opening direction the pin 7 must thus be lifted along a circular arc having its centre in recess 14, and the aperture 15 serves to provide for this movement. The movement of the secondary frame element may be interrupted when the slide reaches a stop in the guidance 10.

We claim:

1. A window, especially for installation in an inclined roof, comprising a main frame, a secondary frame element top-hinged therein, and a frame element lifting lever inserted therebetween and having one end pivotally connected with a side member of the secondary frame element or the main frame while its other end is pivotally and displaceably connected with the associated side member of the main frame or the secondary frame element, respectively, and is urged by a spring for displacement along said side member in a direction away from the hinge point between the main frame and the secondary frame element, said other end of the secondary frame element lifting lever presenting at least two pivot points having different distances from the pivot point at the first mentioned end of the lever and being, moreover, located so as to successively becoming operative during the opening of the window to succesively increasing the effective length of the lever.

2. A window as claimed in claim 1 and in which the said other end of the secondary frame element lifting lever is connected with the spring through a slide displaceable along the side member concerned, wherein said lever comprises three approximately equidistant pivot pins, the central one of which is laterally displaced from the connecting line between the two other pivot pins in a direction pointing away from the first mentioned end of the lever, the slide comprising three corresponding bearing recesses which are mainly in alignment with each other.

3. A window as claimed in claim 2, wherein the bearing recess associated with the central pivot pin is constituted by the one end portion of an elongate aperture provided in the slide.

* * * * *